US007264497B1

(12) United States Patent
Lewis

(10) Patent No.: US 7,264,497 B1
(45) Date of Patent: Sep. 4, 2007

(54) METHOD AND APPARATUS FOR RETAINING A POWER CORD

(75) Inventor: Jeffrey M. Lewis, Maynard, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 11/377,129

(22) Filed: Mar. 16, 2006

(51) Int. Cl.
*H01R 13/62* (2006.01)

(52) U.S. Cl. ..... 439/373; 439/371

(58) Field of Classification Search ..... 439/373, 439/371; D13/156
See application file for complete search history.

(56) References Cited

U.S. PATENT DOCUMENTS 3,960,432 A * 6/1976 Wilbur ..... 439/451
5,567,172 A * 10/1996 Thibault et al. ..... 439/371
2006/0046557 A1* 3/2006 Pulizzi et al. ..... 439/371

* cited by examiner

*Primary Examiner*—Tho D. Ta
*Assistant Examiner*—Vanessa Girardi
(74) *Attorney, Agent, or Firm*—Guerin & Rodriguez, LLP; Michael A. Rodriguez

(57) ABSTRACT

Described are a method and apparatus for keeping a power cord plugged into a plug receptacle. A bracket has a plurality of sidewalls that define an opening sized to frame the plug receptacle of an electronics housing. A first sidewall has an opening therein and a second sidewall has a lock mechanism. The bracket is coupled to the electronics housing so that the first and second sidewalls of the bracket are on opposite sides of the plug receptacle. A cable tie is coupled at the first end to an anchor point near the first sidewall of the bracket. The cable tie has sufficient length to extend from the anchor point through the opening in the first sidewall of the bracket and, after looping around a cord of a power cord that is plugged into the plug receptacle, to couple at the second end to the lock mechanism of the second sidewall of the bracket.

21 Claims, 11 Drawing Sheets

METHOD AND APPARATUS FOR RETAINING A POWER CORD

FIELD OF THE INVENTION

The invention relates generally to electronics systems. More particularly, the invention relates to power cord-retainer assemblies for keeping a power cord firmly plugged into an electronics system.

BACKGROUND

Critical to the proper operation of an electronics system is for the electrical power cord that supplies power to remain connected to the electronics housing. Inadvertent disconnection from the electronics housing can cause system failure. For storage systems, the loss of power can result in data loss and downtime. Notwithstanding, many power cords do not have built-in retention features. Previous efforts to devise a power cord retention mechanism have used a clip or a flange with features designed to grasp and hold a specific style of power cord.

Power cords, however, are generally available in a variety of styles, often determined by the "overmold" of the power cord. The overmold is a transitional plastic or rubber region located between the cord and the receptacle end of the power cord. The use of the overmold is for embedding the wire connections and for providing strain-relief. Because no industry standard governs the size or shape of the overmold, different vendors have produced a variety of differently shaped and sized overmolds. Consequently, a power cord retention mechanism designed for one style of power cord may be inadequate or of no use for another style of power cord.

SUMMARY

In one aspect, the invention features a power cord-retainer assembly including a bracket with a plurality of sidewalls that define an opening. The size of the opening is for framing a plug receptacle of an electronics housing. A first one of the sidewalls has an opening therein and a second one of the sidewalls has a lock mechanism. The power cord-retainer assembly has means for coupling the bracket to the electronics housing so that the first and second sidewalls of the bracket are on opposite sides of the plug receptacle. A cable tie, having first and second ends, is coupled at the first end to an anchor point near the first sidewall of the bracket. The cable tie has sufficient length to extend from the anchor point through the opening in the first sidewall of the bracket and, after looping around a power cord plugged into the plug receptacle, to couple at the second end to the lock mechanism of the second sidewall of the bracket.

In another aspect, the invention features an apparatus including an electronics housing having a plug receptacle for receiving a plug end of a power cord with an overmold. The apparatus also includes means for tying a loop around the power cord adjacent to the overmold, means for coupling a first end of the tying means to an anchor point on one side of the plug receptacle, and means for coupling a second end of the tying means to a locking point on another side of the plug receptacle opposite the side of the anchor point.

In still another aspect, the invention features a method for retaining a power cord plugged into a plug receptacle of an electronics system. The method includes coupling a first end of a cable tie to an anchor point on one side of the plug receptacle, looping the cable tie around the power cord adjacent to an overmold of the power cord, and coupling a second end of the cable tie to a locking point on another side of the plug receptacle opposite the side of the anchor point.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

Electronics systems embodying the invention have a power cord-retention mechanism for retaining a plugged-in power cord. The power cord-retention mechanism includes a bracket and a cable tie that passes through an opening in the bracket. The bracket couples to one side of an electronics system housing, and frames a plug (e.g., an International Electrotechnical Commission (IEC)) receptacle. Anchored at one side of the bracket, the cable tie wraps around the cord of the power cord, behind and adjacent to the power cord's overmold. An installer draws the cable tie taut and secures the free end of the cable tie to a lock mechanism on the opposite side of the bracket. To accommodate the variety of shapes and sizes of power cord overmolds, the installer can secure the cable tie at different points along the cable tie's length.

Figure 1:
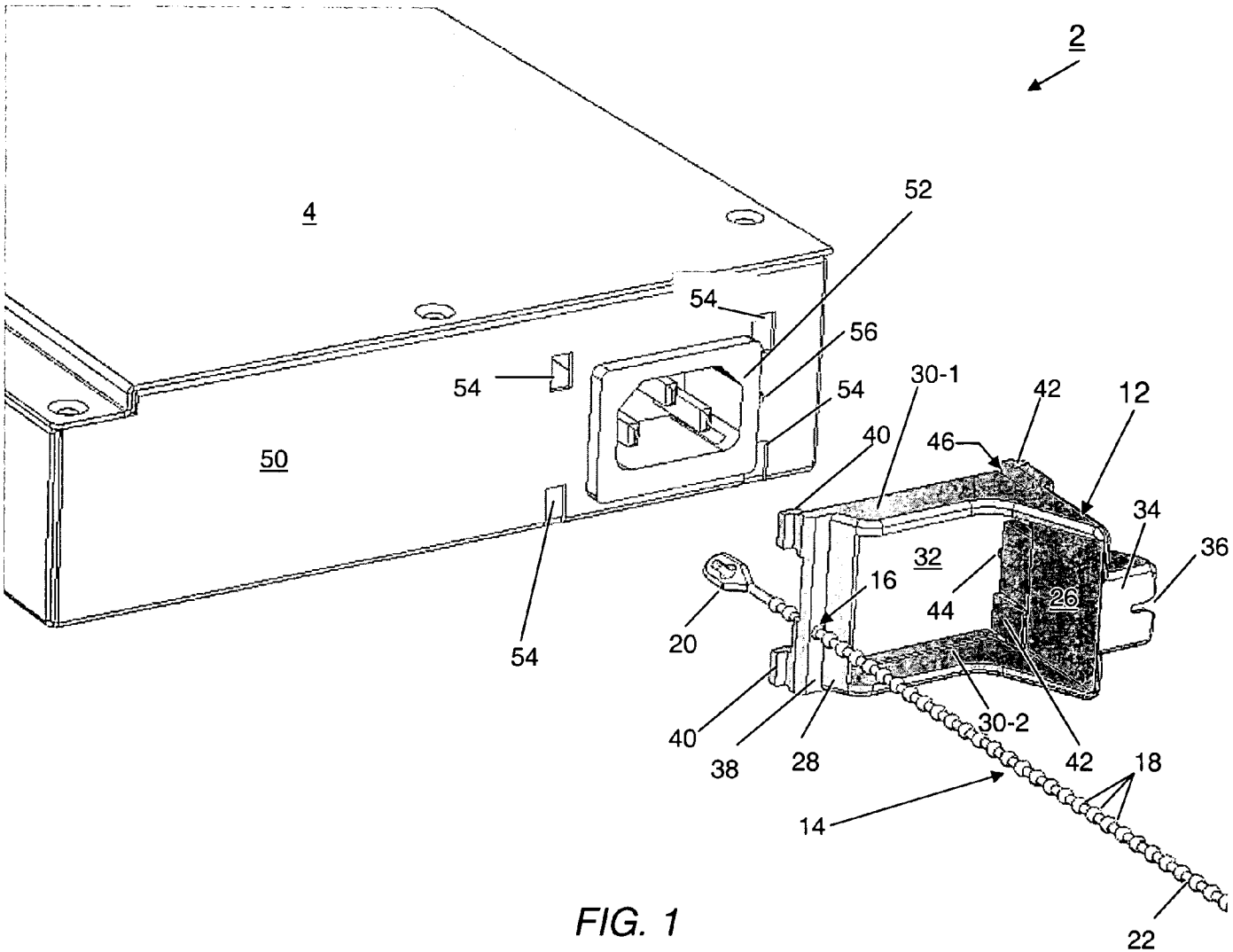
FIG. 1 is a view of an embodiment of a power cord-retainer assembly embodying the invention, the power cord-retainer assembly including a bracket and a cable tie.

FIG. 1 shows an embodiment of a power cord-retainer assembly 2 for use with an electronics system, such as a power supply unit. The power cord-retainer assembly 2 includes a bracket 12 and a cable tie 14 passing through an opening 16 in one side of the bracket 12. The head end 20 of the cable tie 14, which is larger than the opening 16, operates to anchor the cable tie 14 to the bracket 12. The other end 22 of the cable tie 14 is free for looping around the cord of the power cord, as described in more detail below. In one embodiment, the cable tie 14 is industry-standard beaded cable tie, made of flexible plastic (e.g., Nylon, polypropylene), with an evenly spaced succession of protrusions (beads or bumps) 18. For example, the spacing between beads can range from ⅛" to ¼", and bead diameters from 3/32" to ⅛".

The bracket 12 is an integral component, preferably constructed of plastic material, generally rectangular, with four sidewalls 26, 28, 30-1, and 30-2 defining a rectangular opening 32. Sidewall 26 opposes sidewall 28; sidewall 30-1 opposes sidewall 30-2. Extending from an external surface of the sidewall 26 is a lock platform 34 to which the free end 22 of the cable tie 14 becomes secured. The lock platform 34 has a slot 36 into which the cable tie 14 enters laterally, thus functioning as a locking point for the free end 22 of the cable tie 14. A flange 38—having the opening 16 through which the cable tie 14 passes—extends from the base of the sidewall 28 along the sidewall's periphery. A pair of L-shaped feet 40 project from a rear surface of the flange 38, one foot 40 at each end of the flange 38. Extending from a rear edge of the sidewall 26 are a pair of hooked posts 42 and an alignment pin 44. The posts 42 are at opposite ends of the sidewall 26, and the alignment pin 44 at a point therebetween. There is a gap 46 between each post 42 and one of the sidewalls 30-1, 30-2, to provide a degree of flexibility (i.e., for deflection or bending) to the posts 42 (for when the posts are inserted into openings, as described below).

The bracket 12 couples to a panel or wall 50 of the housing 4 of an electronics system, where the bracket 12 frames a plug receptacle 52. This wall 50 also includes a plurality of rectangular openings 54 near the corners of the plug receptacle 52. At one side of the plug receptacle 52 is circular opening 56. The shapes of the openings 54, 56 are exemplary; other shapes may be used in the practice of the invention.

Figure 2:
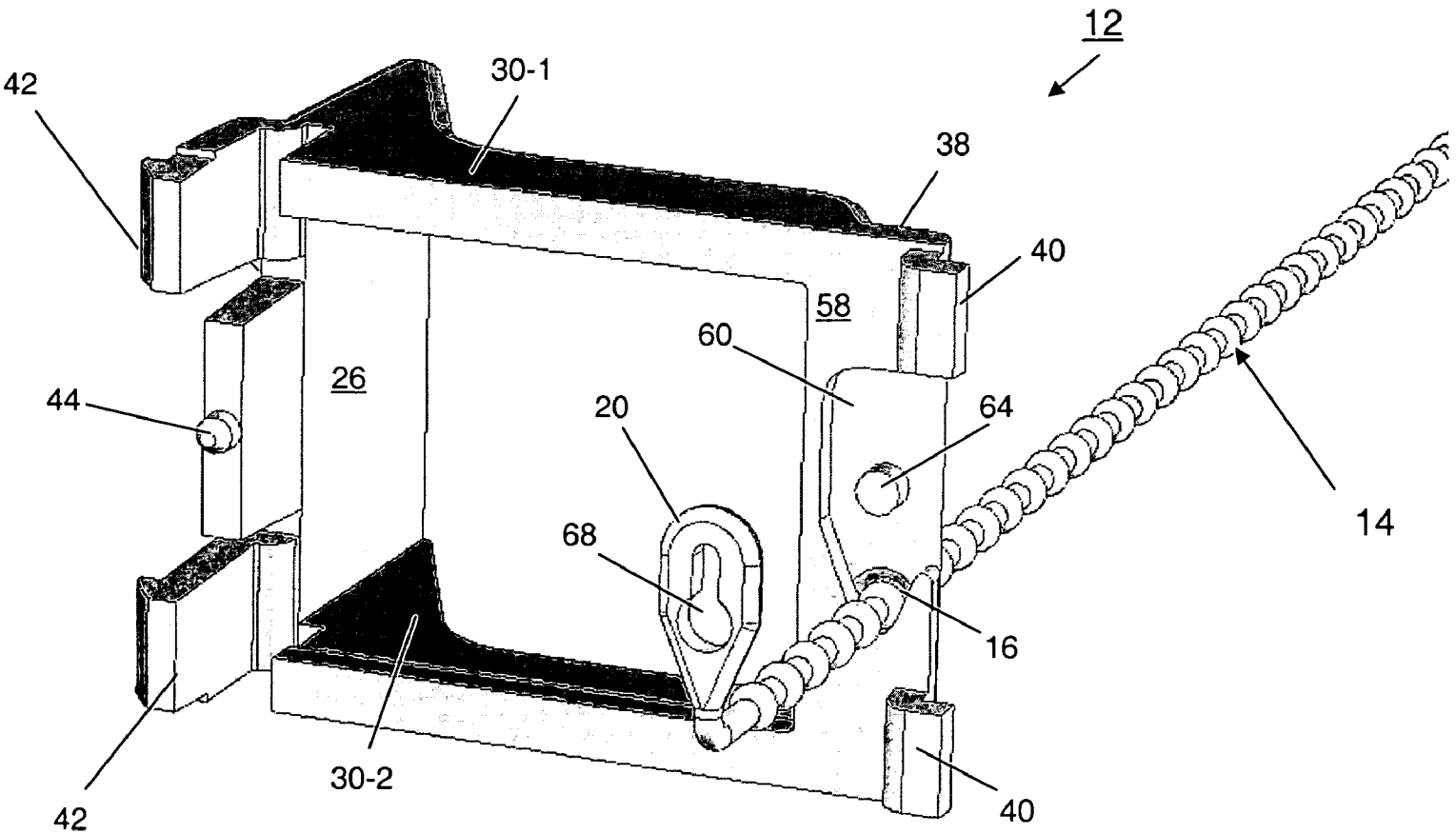
FIG. 2 is a rear view of the bracket of the power cord-retainer assembly.
Figure 3:
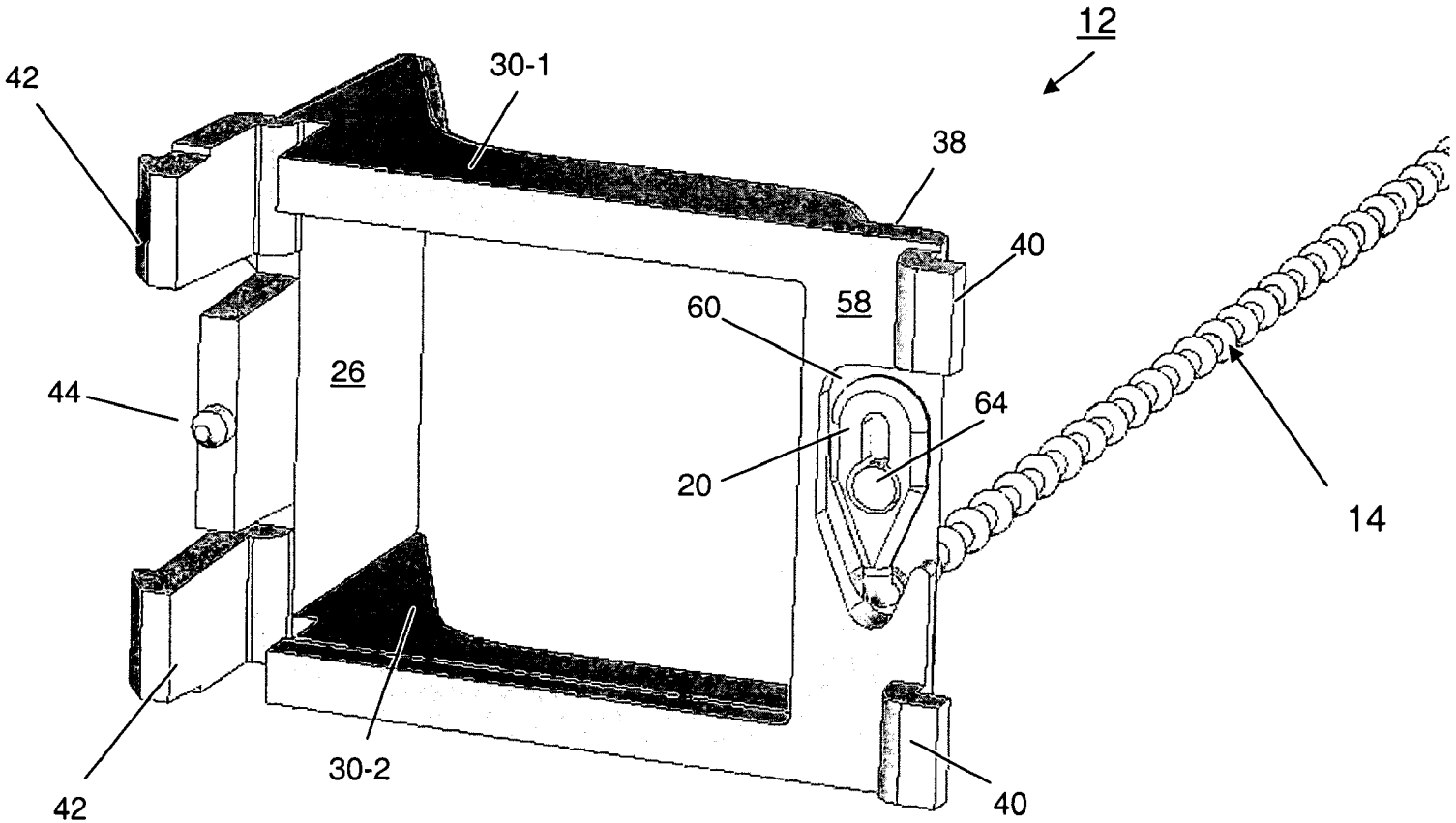
FIG. 3 is a rear view of the bracket of the power cord-retainer assembly showing the cable tie anchored to the bracket.

FIG. 2 shows a rear view of the bracket 12. The rear surface 58 of the flange 38 has a cutout region 60 at the rear side of the sidewall 28. The size and shape of the cutout region 60 are for receiving the head end 20 of the cable tie 14. A circular pin 64 projects from an interior surface of the cutout region 60, and fits closely within a circular section of a keyhole 68 in the head end 20 of the cable tie 14. To fit into the cutout region 60, the head end 20 bends perpendicularly to the cable portion of the cable tie 14. The depth of the cutout region 60 is such that the head-end 20 can lay flush with the rear surface 58 of the flange 38 when the head end 20 is within the cutout region 60, as shown in FIG. 3. The cutout region 60 serves as an embodiment of an anchor point for the cable tie 14.

Figure 4:
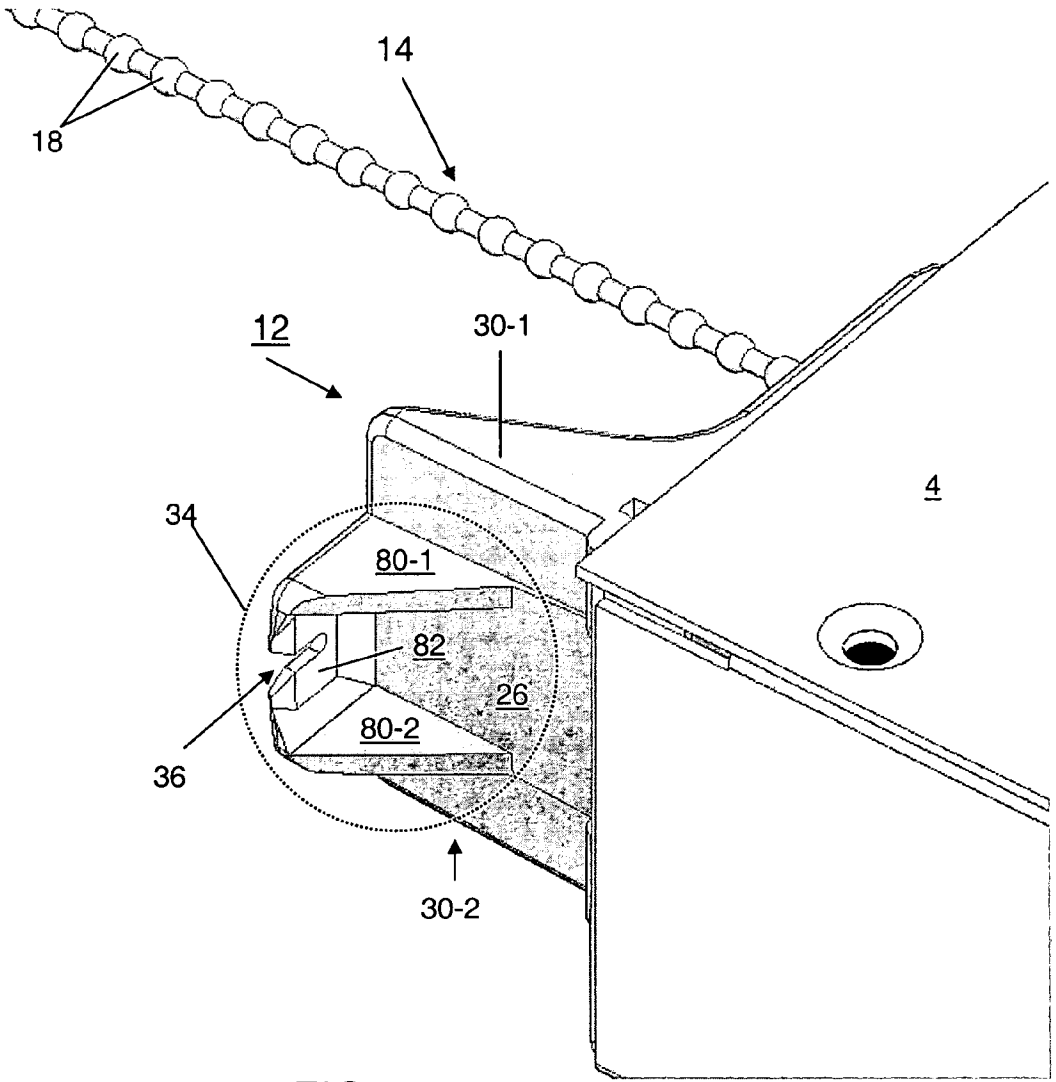
FIG. 4 is a side view of the bracket of the power cord-retainer assembly, the bracket having a beveled slot for receiving the cable tie.

FIG. 4 shows, in more detail, the lock platform 34 extending from the sidewall 26 of the bracket 12. The lock platform 34 includes a pair of spaced-apart, opposing sidewalls 80-1, 80-2 (here, having a triangular shape) and a slotted panel 82 therebetween. The slotted panel 82 has the slot 36 for receiving the cable tie 14. The slot 36 has beveled edges for guiding the cable tie 14 into the slot 36. So that cable tie 14 fits tightly within the slot 36, the width of the slot 36 closely measures to the diameter of the cable portion of the cable tie 14, and the thickness of the slotted panel 82 closely measures to the distance separating adjacent beads 18 of the cable tie 14.

Figure 5:
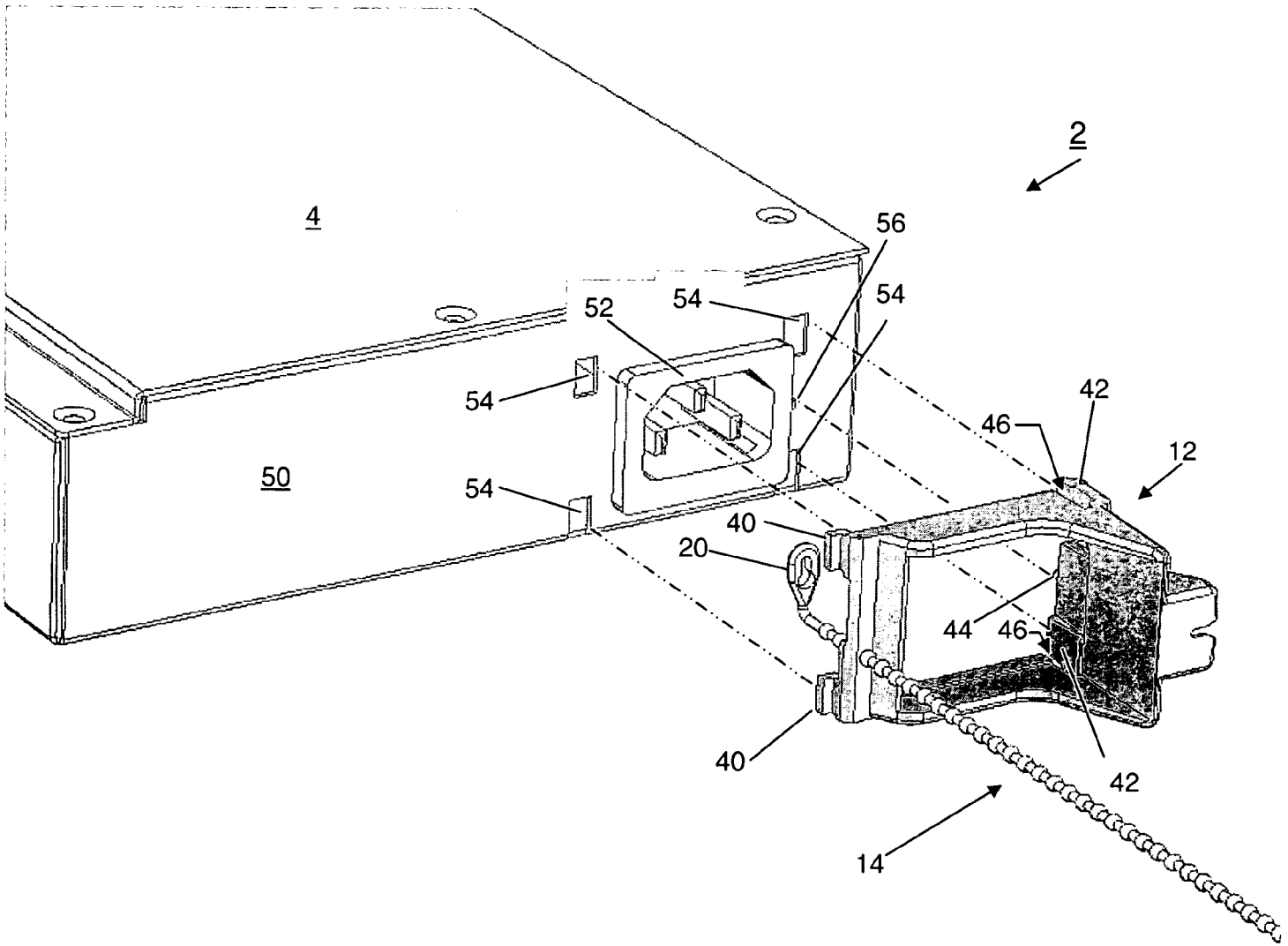
FIG. 5 is a view of the power cord-retainer assembly with the bracket and cable tie aligned with a power cord receptacle of an electronics system, for coupling thereto.

FIG. 5 shows the power cord-retainer assembly 2, with each foot 40 and hooked post 42 of the bracket 12 in alignment with one of the openings 54 around the plug receptacle 52 of the electronics housing 4. The pin 44 is in alignment with the circular opening 56 at a side of the plug receptacle 32. The head end 20 of the cable tie 14 is turned perpendicularly so that the head end 20 can lie between the surface of the wall 50 of the electronics housing 4 and a back surface of the bracket 12 when the bracket 12 is coupled to the electronics housing 4, as shown in FIG. 3.

Figure 6:
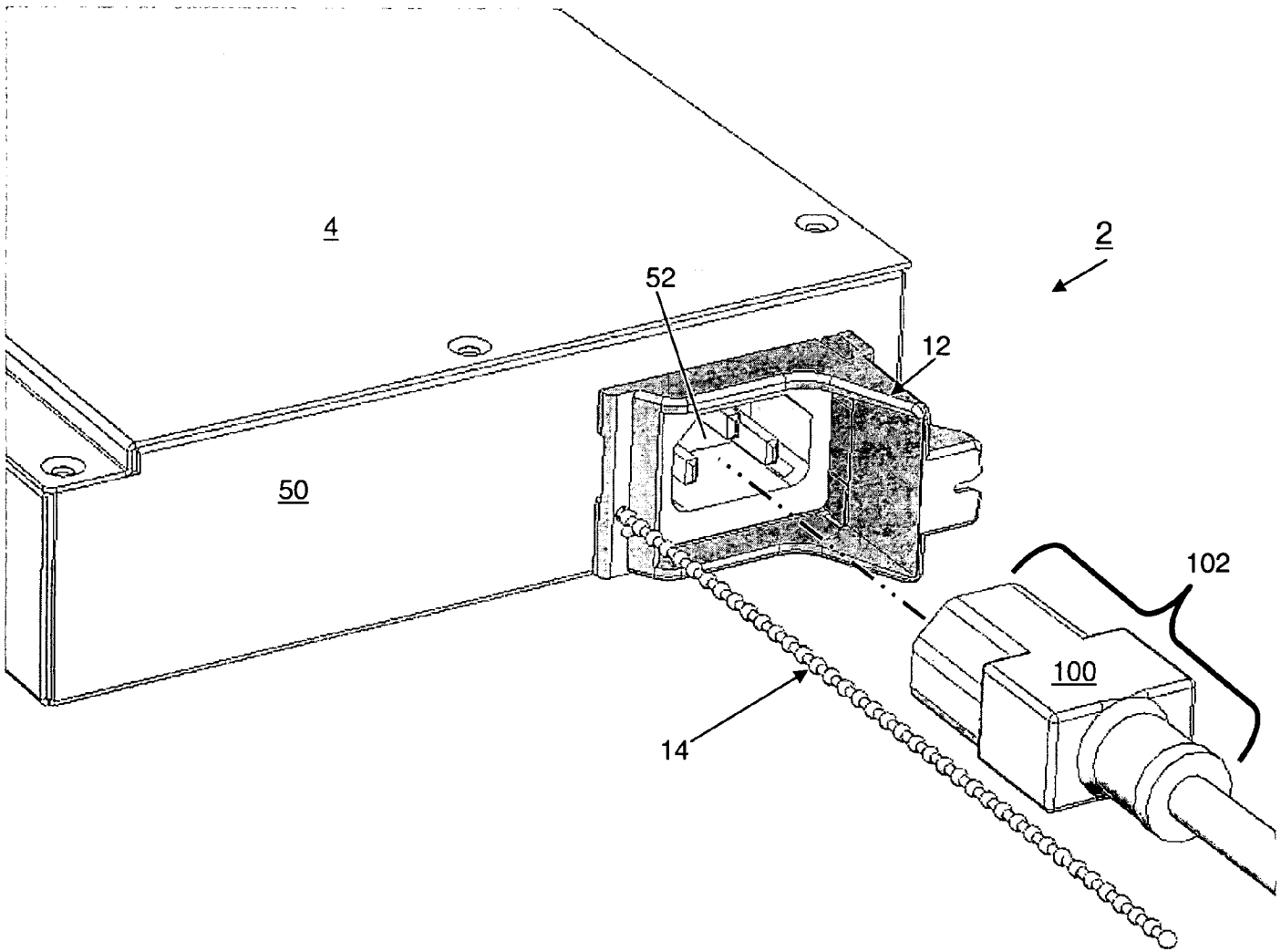
FIG. 6 is a view of the bracket of the power cord-retainer assembly coupled to the housing of the electronics system.
Figure 7:
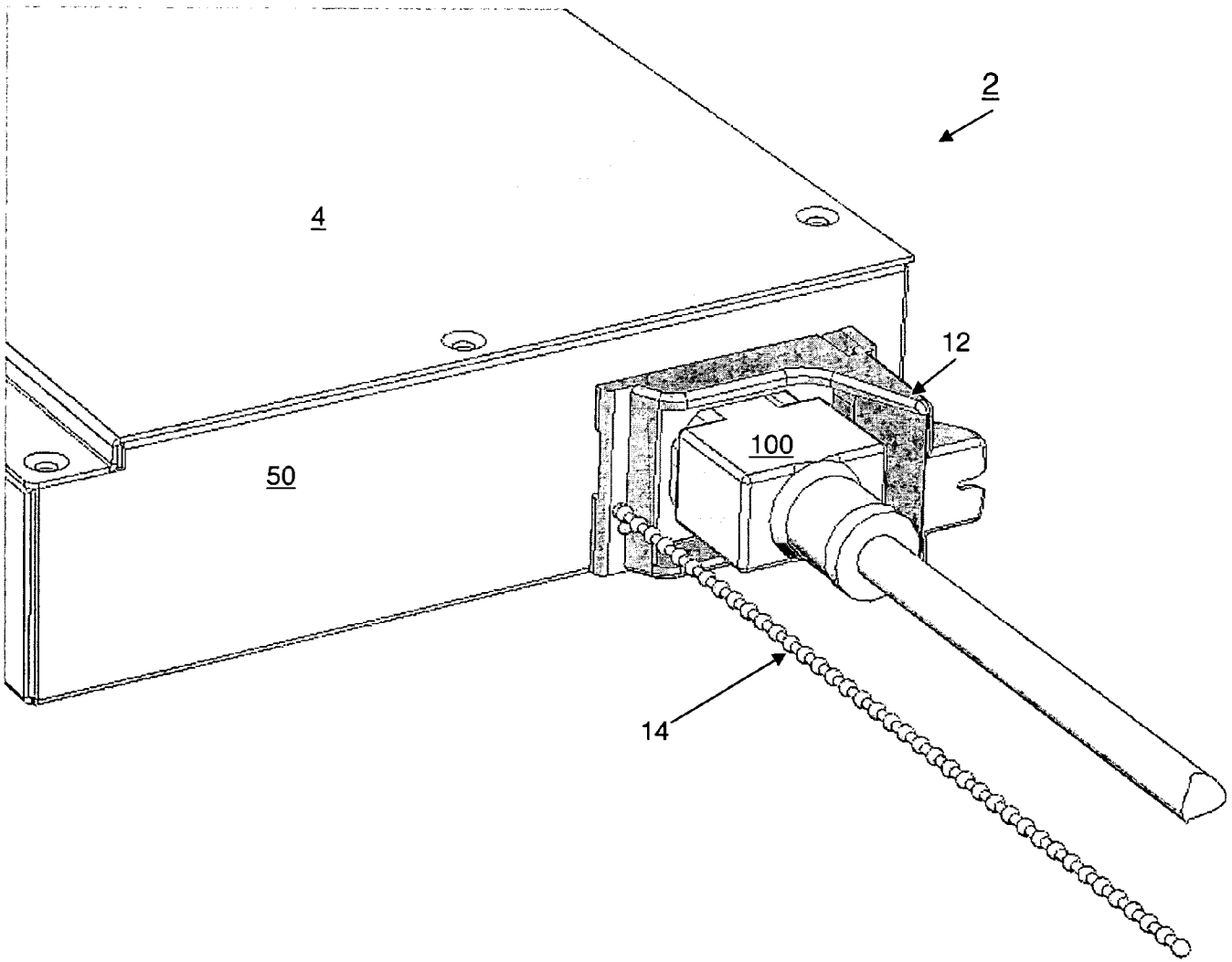
FIG. 7 is a view of the bracket of the power cord-retainer assembly coupled the electronics system and of the power cord plugged into the power cord receptacle.

To couple the bracket 12 to the electronics housing 4, an assembler first inserts the L-shaped feet 40 into the corresponding openings 54 and then inserts the hooked posts 42 and pin 44 into their respective openings 54, 56. When being inserted into the openings 54, the hooked posts 42 bend inwards (toward the gaps 46) and then snap back into place, securing the bracket 12 to the wall 50 of the electronics housing 4. Thus, the bracket 12 can be coupled to the electronics housing without the use of separate mechanical fasteners, such as screws, bolts, and nuts, although other embodiments can use such fasteners without departing from the principles of the invention. FIG. 6 shows the bracket 12 coupled to the electronics housing 4, and the plug end 100 (with overmold 102) of a power cord aligned for entry into the plug receptacle 52. FIG. 7 shows the plug end 100 of the power cord plugged into the power cord receptacle 52.

Figure 8:
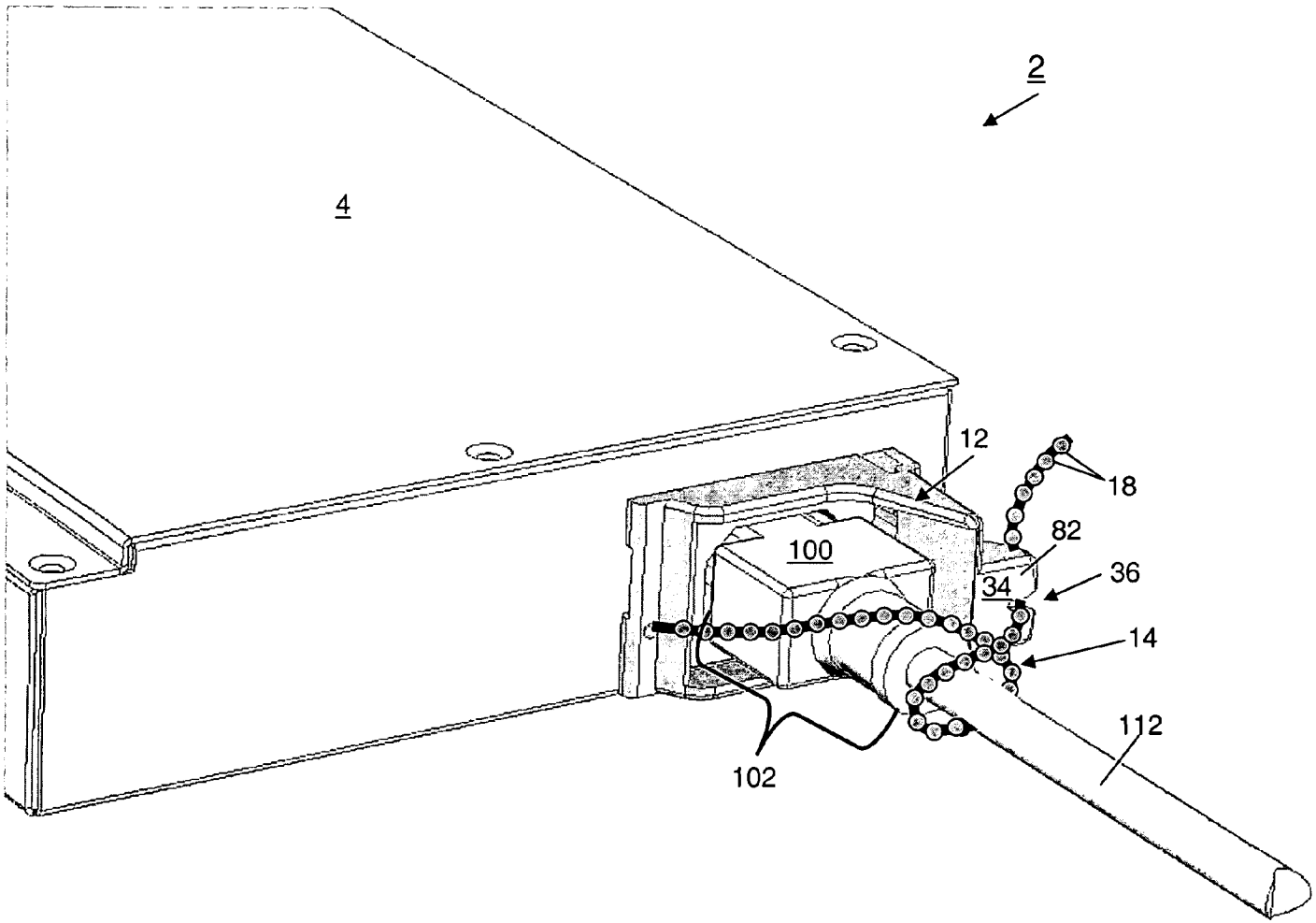
FIG. 8 is a view of the cable tie looped around the power cord and secured at the free end to the beveled slot of the bracket.

FIG. 8 shows the power cord-retainer assembly 2 after installation. Anchored to the bracket 12 at one end, the cable tie 14 wraps at least once around the cord 112 of the power cord behind the overmold 102 and wedges into the beveled slot 36 of the bracket 12. Looping the cable tie 14 behind the overmold 102 enables use of the power cord-retainer assembly 2 with various types of power cords because the size and shape of the overmold does not affect the installation and operation of the retention assembly, provided the cable tie 14 be of sufficient length. The regularly spaced beads 18 provide several points along the cable tie 14 at which an installer may couple the cable tie 14 to the lock platform 34, and thus ensure that the cable tie 14 is taut when installed.

When the cable tie 14 is wedged into the slot 36, adjacent beads 18 capture the slotted panel 82 between them, to "lock" the cable tie 14 to the lock platform 34. Pulling on the power cord in an attempt to unplug operates to tighten the cable tie 14 by wedging the cable tie 14 farther into the slot 36 of the bracket 12.

Figure 9:
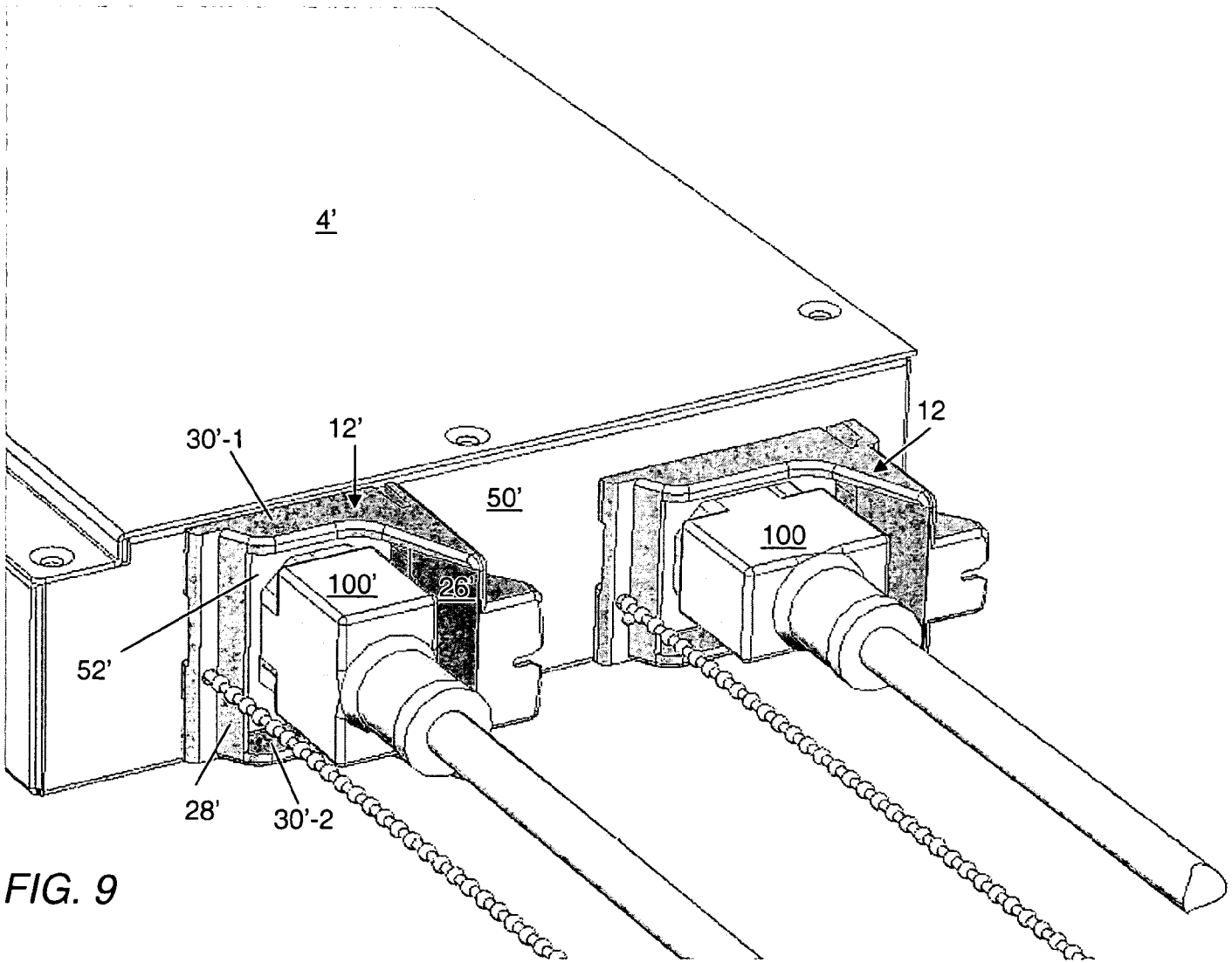
FIG. 9 is a view of an alternative embodiment of a bracket of a power cord-retainer assembly for use with vertically oriented plug receptacles.

FIG. 9 shows an alternative embodiment of a bracket 12' for use in retaining power cords that are plugged into vertically oriented plug (e.g., IEC) receptacles. In this embodiment, the sidewalls 26', 28', 30'-1, 30'-2 framing the vertically oriented plug receptacle 52' generally define a squarish opening.

Figure 10:
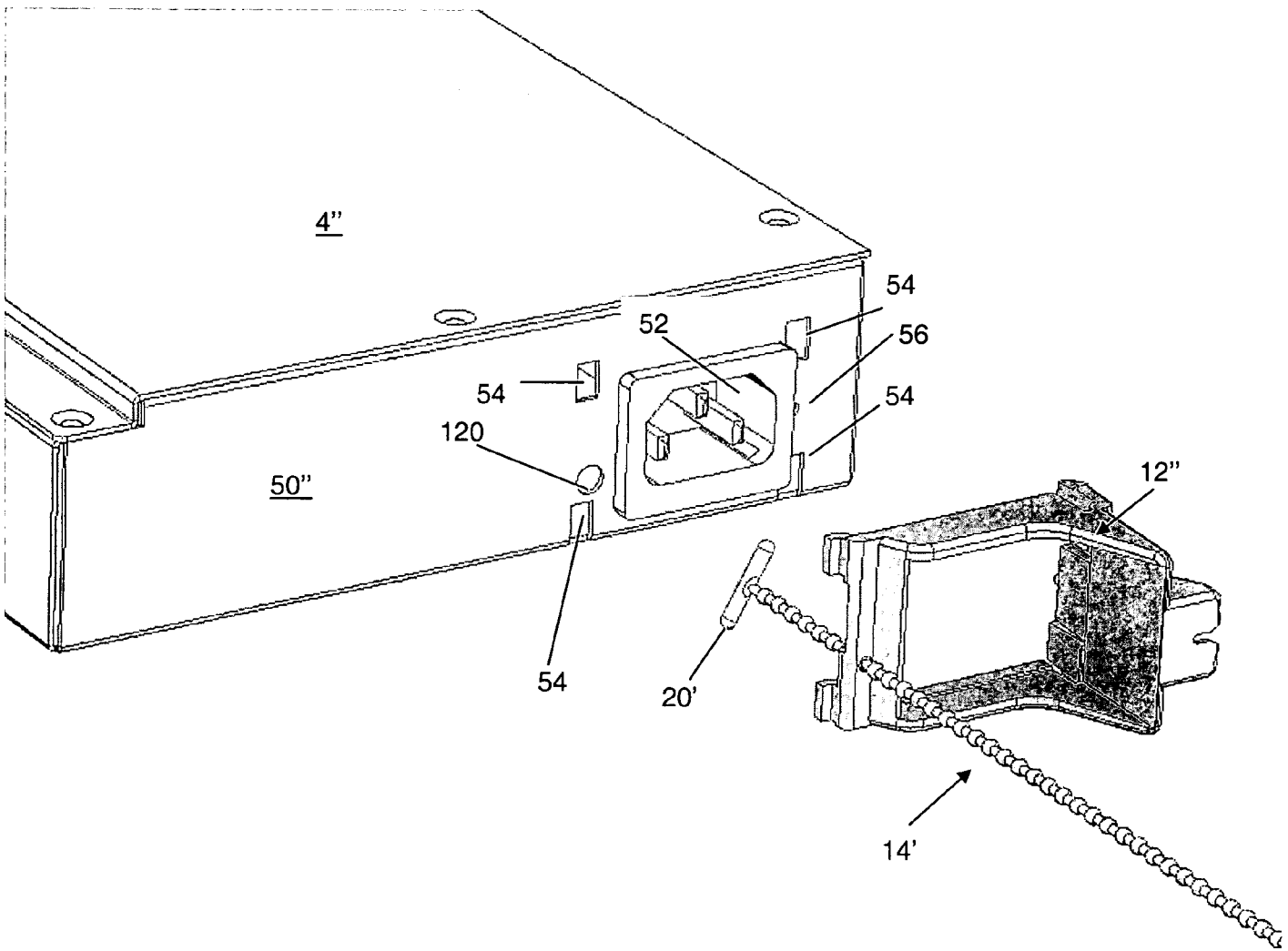
FIG. 10 is a view of an alternative embodiment of a cable tie for use in a power cord-retainer assembly.
Figure 11:
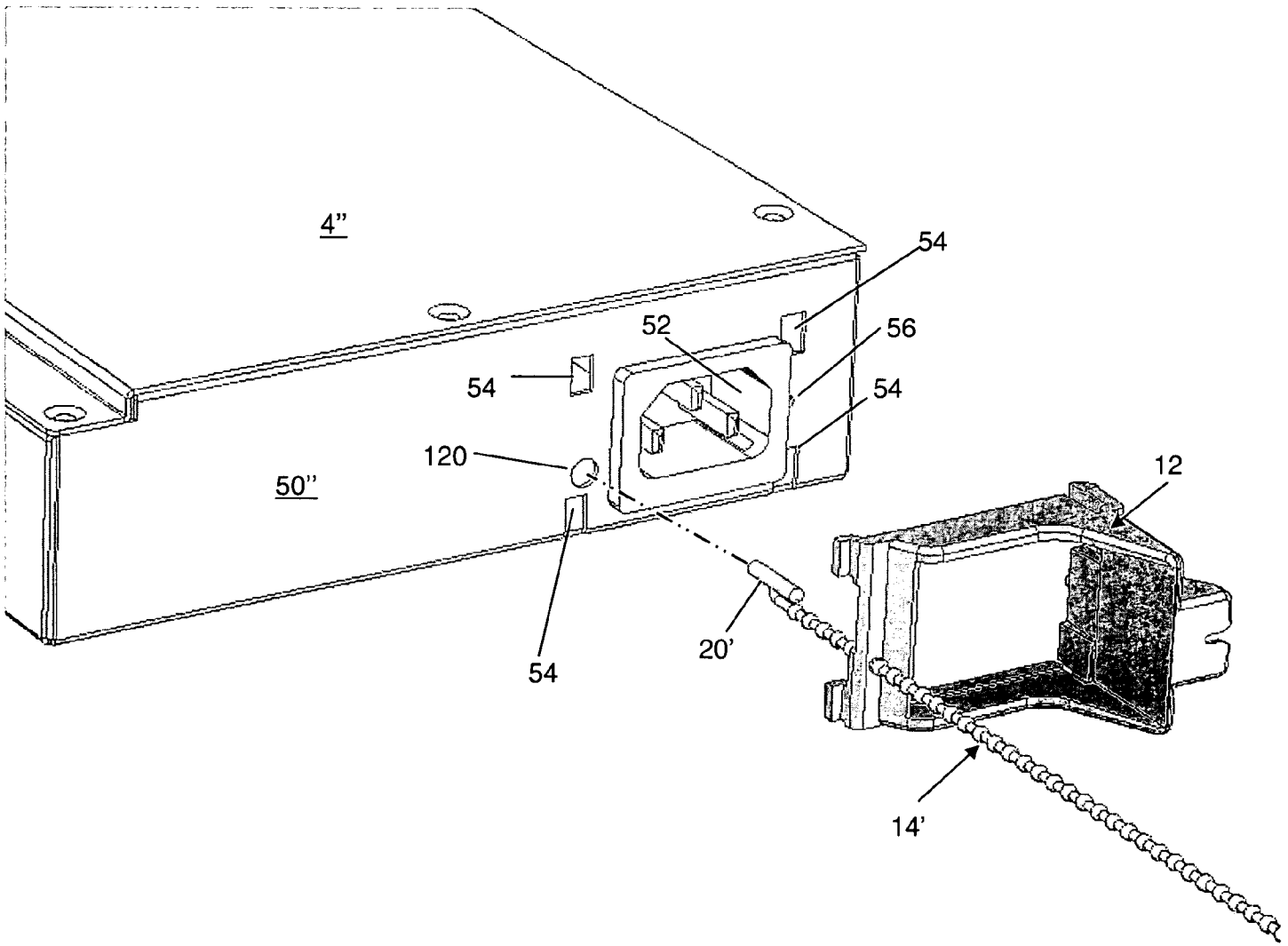
FIG. 11 is a view of the power cord-retainer assembly of FIG. 10, with the cable tie folded for entering into an opening in the housing of the electronics system.

FIG. 10 shows an alternative embodiment of a cable tie 14' for use in a power cord-retainer assembly to wrap around a cord of a power cord. This embodiment of the cable tie 14' has a T-shaped head end 20'. The head end 20' can anchor to the rear side of a bracket 12", like the keyhole shaped head end 20 described in FIG. 2, provided the rear surface of the bracket 12" has a cutout region sized and shaped to receive at least a portion of the T-shaped head end 20'. Alternatively, the wall 50" of the electronics housing 4" has an opening 120 adjacent to the plug receptacle 52, for receiving the T-shaped head end 20'. FIG. 11 shows the T-shaped head end 20' of the cable tie 14' folded back over the cable portion of the cable tie 14', to enable the T-shaped head end 20' to enter into the opening 120 of the electronics housing 4". After passing completely through the opening 120, the T-shaped head end 20' returns to its original T-shape, thus preventing the cable tie 14' from being pulled out of the opening 120. Accordingly, the opening 120 as an embodiment of an anchor point for the cable tie 14'.

While the invention has been shown and described with reference to specific preferred embodiments, it should be understood by those skilled in the art that various changes in form and detail may be made therein without departing from the spirit and scope of the invention as defined by the following claims. For example, alternatives to the beaded cable tie may be used to wrap around the cord of a power cord and to anchor to the bracket or to the wall of the electronics housing. Such tying means include non-beaded cable ties, chains (e.g., beaded key chain), string, wire, cable, cords, and line. To anchor such tying means to the bracket, for example, knots such as stopper knots may be used when the tying means does not inherently have structure to prevent it from pulling through the opening 16 in the bracket 14 or from decoupling from the beveled slot 36. Further, alternatives to the lock platform 34 and beveled slot 36 may be used to serve as an anchor for the free end of a tying means, depending upon the particular tying means used. Examples of anchoring means include, but are not limited to, hitching posts, catches, clasps, posts, and eyelets.

What is claimed is:

1. A power cord-retainer assembly for retaining a power cord that is plugged into a plug receptacle, the power cord having a plug end and a cord, the power cord-retainer assembly comprising:

a bracket having a plurality of sidewalls that define an opening sized to frame the plug receptacle, a first one of the sidewalls having an opening therein and a second one of the sidewalls having a lock mechanism;

means for coupling the bracket at the plug receptacle so that the first and second sidewalls of the bracket are on opposite sides of the plug receptacle; and a cable tie having first and second ends, the cable tie being coupled at the first end to an anchor point near the first sidewall of the bracket, the cable tie extending from the anchor point through the opening in the first sidewall of the bracket and, after looping around the cord of the power cord that is plugged into the plug receptacle, coupling at the second end to the lock mechanism of the second sidewall of the bracket.

2. The power cord-retainer assembly of claim 1, wherein the cable tie is a beaded cable tie.

3. The power cord-retainer assembly of claim 1, wherein the cable-tie loops around the cord of the power cord adjacent to an overmold of the power cord.

4. The power cord-retainer assembly of claim 1, wherein the first end of the cable tie is larger than the opening in the first sidewall of the bracket; and the first sidewall of the bracket has a cutout region at the opening, the cutout region being shaped and sized to receive the first end of the cable tie.

5. The power cord-retainer assembly of claim 1, wherein the lock mechanism includes a platform extending from the second sidewall of the bracket, the platform having a slot for closely receiving the cable tie.

6. The power cord-retainer assembly of claim 1, wherein the cable tie can be reusably decoupled from the lock mechanism.

7. An apparatus for retaining a power cord, the power cord having a plug end, an overmold, and a cord, the apparatus comprising:

an electronics housing having a wall with a plug receptacle therein for receiving the plug end of the power cord with the overmold, the wall having an opening therein adjacent to the plug receptacle;

means for tying a loop around the cord of the power cord adjacent to the overmold;

first means for coupling a first end of the tying means to an anchor point on one side of the plug receptacle, the first coupling means including the opening in the wall of the electronics housing into which the first end of the tying means enters and anchors; and second means for coupling a second end of the tying means to a locking point on another side of the plug receptacle opposite the side of the anchor point, wherein the tying means is coupled at its first end to the anchor point by the first coupling means, loops around the cord of the power cord, and is coupled at its second end to the locking point by the second coupling means.

8. The apparatus of claim 7, wherein the tying means includes a beaded cable tie.

9. The apparatus of claim 7, further comprising a bracket framing the plug receptacle.

10. The apparatus of claim 9, wherein the means for coupling the first end of the tying means includes an opening in a flange of the bracket through which the tying means passes, the first end of the tying means being larger than the opening in the flange to prevent the tying means from pulling entirely through the flange opening.

11. The apparatus of claim 9, wherein the means for coupling the second end of the tying means includes a platform extending from a sidewall of the bracket, the platform having a slot for closely receiving the tying means.

12. The apparatus of claim 9, further comprising means for coupling the bracket to the electronics housing.

13. A method for retaining a power cord plugged into a plug receptacle, the power cord having a plug end and a cord, the method comprising:

coupling a first end of a cable tie to an anchor point on one side of the plug receptacle by providing an opening in a wall of an electronics system adjacent to the plug receptacle into which the first end of the cable tie enters and becomes anchored;

looping the cable tie around the cord of the power cord adjacent to an overmold of the power cord; and coupling a second end of the cable tie to a locking point on another side of the plug receptacle opposite the side of the anchor point.

14. The method of claim 13, wherein the step of coupling the first end of the cable tie to the anchor point includes the steps of:

framing the plug receptacle with a bracket having a sidewall with an opening therein; and threading the cable tie through the opening, the first end of the cable tie being larger than the opening to prevent the cable tie from pulling entirely through the opening.

15. The method of claim 13, wherein the step of coupling the second end of the cable tie to the locking point includes the steps of:

framing the plug receptacle with a bracket having a slotted panel extending from a sidewall of the bracket; and sliding the cable tie into a slot of the slotted panel.

16. The method of claim 13, further comprising the step of coupling a bracket to a housing of an electronics system.

17. The method of claim 13, further comprising the step of reusably decoupling the second end of the cable tie from the locking point.

18. An electronics system comprising:

an electronics housing having a wall with a plug receptacle therein;

a power cord having a plug end and a cord, the plug end of the power cord being plugged into the plug receptacle; and a power cord-retainer assembly for retaining the power cord in the plug receptacle, the power cord-retainer assembly including:

a bracket having a plurality of sidewalls that define an opening sized to frame the plug receptacle, a first one of the sidewalls having an opening therein and a second one of the sidewalls having a lock mechanism;

means for coupling the bracket at the plug receptacle so that the first and second sidewalls of the bracket are on opposite sides of the plug receptacle; and a cable tie having first and second ends, the cable tie being coupled at the first end to an anchor point near the first sidewall of the bracket, the cable tie extending from the anchor point through the opening in the first sidewall of the bracket and, after looping around the cord of the power cord that is plugged into the plug receptacle, coupling at the second end to the lock mechanism of the second sidewall of the bracket.

19. The electronics system of claim 18, wherein the power cord includes an overmold and the cable-tie loops around the cord of the power cord behind the overmold of the power cord.

20. The electronics system of claim 18, wherein wall of the electronics housing includes an opening adjacent to the plug receptacle, and the first end of the cable tie enters and anchors within the opening of the wall.

21. The electronics system of claim 18, wherein the first end of the cable tie is larger than the opening in the first sidewall of the bracket so that the cable tie is unable to pass through the opening in the first sidewall, thereby becoming anchored at the opening when the second end of the cable tie is coupled to the lock mechanism of the second sidewall of the bracket.

* * * * *